US007585387B2

(12) United States Patent
Day et al.

(10) Patent No.: US 7,585,387 B2
(45) Date of Patent: Sep. 8, 2009

(54) CHEMICAL OXIDATION FOR CELLULOSE SEPARATION WITH A HYPOCHLORITE AND PEROXIDE MIXTURE

(75) Inventors: Donal F. Day, Baton Rouge, LA (US); Chang-Ho Chung, Baton Rouge, LA (US)

(73) Assignee: Board of Supervisors of Louisiana State University And Agricultural and Mechanical College, Baton Rouge, LA (US)

( * ) Notice: Subject to any disclaimer, the term of this patent is extended or adjusted under 35 U.S.C. 154(b) by 193 days.

(21) Appl. No.: 11/371,523

(22) Filed: Mar. 8, 2006

(65) Prior Publication Data

US 2006/0207734 A1 Sep. 21, 2006

Related U.S. Application Data

(60) Provisional application No. 60/660,801, filed on Mar. 11, 2005.

(51) Int. Cl.
*D21C 3/00* (2006.01)

(52) U.S. Cl. ..... 162/78; 162/70; 162/87; 162/91

(58) Field of Classification Search ..... 162/78, 162/70, 87, 91
See application file for complete search history.

(56) References Cited

U.S. PATENT DOCUMENTS

| | | | | | |
|---|---|---|---|---|---|
| 1,705,825 | A | | 3/1929 | Odeen | 554/192 |
| 1,768,822 | A | | 1/1930 | Bradley et al. | 162/78 |
| 2,465,327 | A | * | 3/1949 | McEwen | 162/71 |
| 3,642,580 | A | | 2/1972 | Ghose | 195/33 R |
| 3,764,475 | A | * | 10/1973 | Mandels et al. | 435/105 |
| 3,915,959 | A | * | 10/1975 | Goheen et al. | 536/101 |
| 4,008,120 | A | * | 2/1977 | Carles et al. | 162/89 |
| 5,562,777 | A | | 10/1996 | Farone et al. | 127/37 |
| 5,597,714 | A | | 1/1997 | Farone et al. | 435/100 |

(Continued)

FOREIGN PATENT DOCUMENTS

| | | |
|---|---|---|
| WO | WO 96/40970 | 10/1996 |

(Continued)

OTHER PUBLICATIONS

Donal Day et al., ACS Chemical Abstract [downloaded online fromhttp://oasys2.confex.com/acs/229nm/techprogram/], availible online Jan. 10, 2005 [downloaded Mar. 5, 2008], 229 ACS Conference, abstract only availible.*

(Continued)

*Primary Examiner*—Eric Hug
*Assistant Examiner*—Anthony J Calandra
(74) *Attorney, Agent, or Firm*—Bonnie J. Davis; John H. Runnels

(57) ABSTRACT

An oxidative solution (Ox-B, a solution of no less than 5:1 sodium hypochlorite: hydrogen peroxide) was found to remove both lignin and hemicellulose from sugarcane bagasse. After treatment the cellulosic residue readily separated from the lignin and hemicellulose by sedimentation. The residue (the pulp) contained up to 80% by weight cellulose, and was easily degradable by cellulase enzyme. A treatment of oxidation with low concentrations of Ox-B, followed by a caustic wash, produced a cellulose residue that was able to be almost completely hydrolyzed to simple sugars by cellulase. Due to the low amount chemical used and the efficiency of the degradation, this process has commercial potential.

29 Claims, 8 Drawing Sheets

U.S. PATENT DOCUMENTS

| | | | | |
|---|---|---|---|---|
| 5,782,982 | A | 7/1998 | Farone et al. | 127/37 |
| 6,660,702 | B2 * | 12/2003 | Ajmani et al. | 510/195 |
| 2002/0129912 | A1 * | 9/2002 | Reinhard et al. | 162/78 |

FOREIGN PATENT DOCUMENTS

| | | |
|---|---|---|
| WO | WO 96/33308 | 12/1996 |

OTHER PUBLICATIONS

Smook, Handbook for Pulp and Paper Technologists, 1992, Angus Wilde Publications, 2nd edition, chapter 11.*

Smook, Handbook for Pulp and Paper Technologists, 1992, Angus Wilde Publications, 2nd edition, p. 163.*

Bentivenga, G. et al., "Singlet oxygen medicated degradation of Klason lignin," Chemosphere, vol. 39, pp. 2409-2417 (1999).

Chung, Chang-Ho et al., "Chemical Oxidation for Cellulose Separation," a poster presented at the American Chemical Society Meeting, San Diego, California, Mar. 13, 2005 (copy as sent with Provisional Application as Appendix A).

Fox, D.J. et al., "Factors affecting the enzymic susceptibility of alkali and acid pretreated sugar-cane bagasse," J. Chem. Tech. Biotechnol., vol. 40, pp. 117-132 (1987).

Mosier, N. et al., "Features of promising technologies for pretreatment of lignocellulosic biomass," Bioresource Technology, vol. 96, pp. 673-686 (2005).

Neureiter, M. et al., "Dilute-acid hydrolysis of sugarcane bagasse at varying conditions," Applied Biochemistry and Biotechnology, vol. 98-100, pp. 49-56 (2002).

Szabo, J. et al., "Utilization of NaCIO and H2O2 as a source of the singlet oxygen for the environmental bleaching of pulp," Cellulose Chemistry and Technology, vol. 28, pp. 183-194 (1994).

* cited by examiner

CHEMICAL OXIDATION FOR CELLULOSE SEPARATION WITH A HYPOCHLORITE AND PEROXIDE MIXTURE

The benefit of the filing date of provisional U.S. application Ser. No. 60/660,801, filed Mar. 11, 2005, is claimed under 35 U.S.C. § 119(e).

This invention pertains to a new method to convert biomass (for example, sugarcane bagasse) to obtain soluble lignins, hemicellulose, and cellulose by using a strong oxidant solution of a combination of hypochlorite and peroxide.

Cellulose comprises the major part of all plant biomass, and the source of all cellulose is the structural tissues of plants. Cellulose often occurs in close association with hemicellulose and lignin, major components of plants. Cellulose consists of long chain beta-glucosidic residues, linked through the 1,4 positions. This linkage allows cellulose chains to crystallize, and crystallized cellulose is hard to enzymatically hydrolyze. Hemicellulose is an amorphous heteropolymer which can be hydrolyzed when separated from lignocellulose. Lignin, a polyphenolic polymer, is interspersed among the cellulose and hemicellulose with plant fiber cells, and retards enzymatic hydrolysis of cellulose. Attempts to hydrolyze cellulose in biomass have not succeeded in finding an economical method to produce high yields of sugars, primarily due to the crystalline structure of cellulose and the presence of lignin. See U.S. Pat. No. 5,782,982.

Bagasse is the lignocellulosic waste portion of sugarcane, after it has been extracted in a sugar mill. Bagasse is not a homogeneous material, but rather contains the remains of stalks and leaves from the sugarcane plant and mud from the fields. The major carbohydrate components are called polyglucans. The polyglucans contain about 40 hydrogen-bonded glucose chains per fibril, and include chains of cellulose, hemicellulose, polyxylose and arabinose, approximately 3-4 glucan chains per xylan chain, all glued together with lignin. Some of the lignin is covalently linked to cellulose and some to hemicellulose. The hemicellulose is not normally linked to the cellulose. Cellulose buried to the inside of the fibers is generally crystalline in nature, and difficult to hydrolyze with enzymes. Sugarcane bagasse is a typical lignocellulosic waste and contains about 40% cellulose, 27% hemicellulose, 20% lignin, and 13% water-soluble substances. See M. Neurciter et al., "Dilute-acid hydrolysis of sugarcane bagasse at varying conditions," Applied Biochemistry and Biotechnology, vol. 98-100, pp. 49-56 (2002).

Several treatments for lignocellulosic materials have been developed for disrupting and separating the components, i.e., lignin, hemicellulose, and cellulose. Most of these treatments are either expensive or inefficient, or result in environmentally problematic wastes due to the amount and types of chemicals used. Many involve some form of acid or alkaline treatment. See U.S. Pat. Nos. 5,782,982; 5,597,714; 5,562,777; and International Publication No. WO 96/40970. Treatment of lignocellulosic material with a mild acid at high temperatures is known to remove the hemicellulose and lignin and some of the cellulose. A strong acid treatment, however, will degrade all three components. Treatment with alkali is known to remove some lignin and hemicellulose, but some lignin remains chemically bound to cellulose. See N. Mosier et al., "Features of promising technologies for pretreatment of lignocellulosic biomass," Bioresource Technology, vol. 96, pp. 673-686 (2005). The composition of solids obtained after alkaline or mild acid treatment have been shown to be the following:

| Treatment | % Cellulose | % Hemicellulose | % Lignin |
|---|---|---|---|
| water | 35.4 | 22.8 | 20.1 |
| NaOH (0.1 g/g) | 44.5 | 26.8 | 11.8 |
| $H_2SO_4$ (0.02 g/g) | 38.9 | 16.4 | 18.5 |

See D. J. Fox et al, "Factors affecting the enzymic susceptibility of alkali and acid pretreated sugar-cane bagasse," J. Chem. Tech. Biotechnol., vol. 40, pp. 117-132 (1987). As shown in the table, alkali (NaOH) removed more lignin, while acid ($H_2SO_4$) removed more hemicellulose.

Of primary concern to the paper industry is to remove lignin for paper pulping and to bleach the pulp. This usually requires some form of both acid and alkali treatment following by a bleaching process, with hypochlorite and/or peroxide. See J. Szabo et al, "Utilization of NaClO and H2O2 as a source of the singlet oxygen for the environmental bleaching of pulp," Cellulose Chemistry and Technology, vol. 28, pp. 183-194 (1994); and G. Bentivenga et al., "Singlet oxygen medicated degradation of Klason lignin," Chemosphere, vol. 39, pp. 2409-2417 (1999). Nascent oxygen (or atomic oxygen) has also been suggested for use in delignification of a cellulosic biomass. See International Publication No. WO 96/33308.

There is a need for a simple method to convert biomass to its components that can easily be separated, and to expose the cellulose to hydrolysis by cellulases, enzymes known to breakdown cellulose into mono- and di-saccharides.

We have discovered a simple method for converting biomass (for example, sugarcane bagasse) to recoverable fractions, i.e., a solid cellulose fraction (the pulp) and a soluble lignin and hemicellulose fraction. The cellulose fraction was easily separated by known methods (e.g., filtration, sedimentation, centrifugation), and was easily converted to component sugars by known cellulase enzymes. This simple method involved the treatment of biomass with a solution that generates highly oxidizing-singlet oxygen, e.g., a combination of hypochlorite and peroxide, at a ratio no less than 5:1 hypochlorite to peroxide, with a preferred ratio of 10:1. This method required a substantially lower ratio of dry weight of chemical added per dry weight of starting biomass than found in current methods. The preferred ratio of chemical dry weight to biomass dry weight was found to be no greater than 1:1, the more preferred ratio no greater than 0.4:1, and the most preferred ratio no greater than 0.2:1. To enhance cellulose access, the residual cellulose may be treated with alkali prior to enzymatic hydrolysis.

Figure 1:
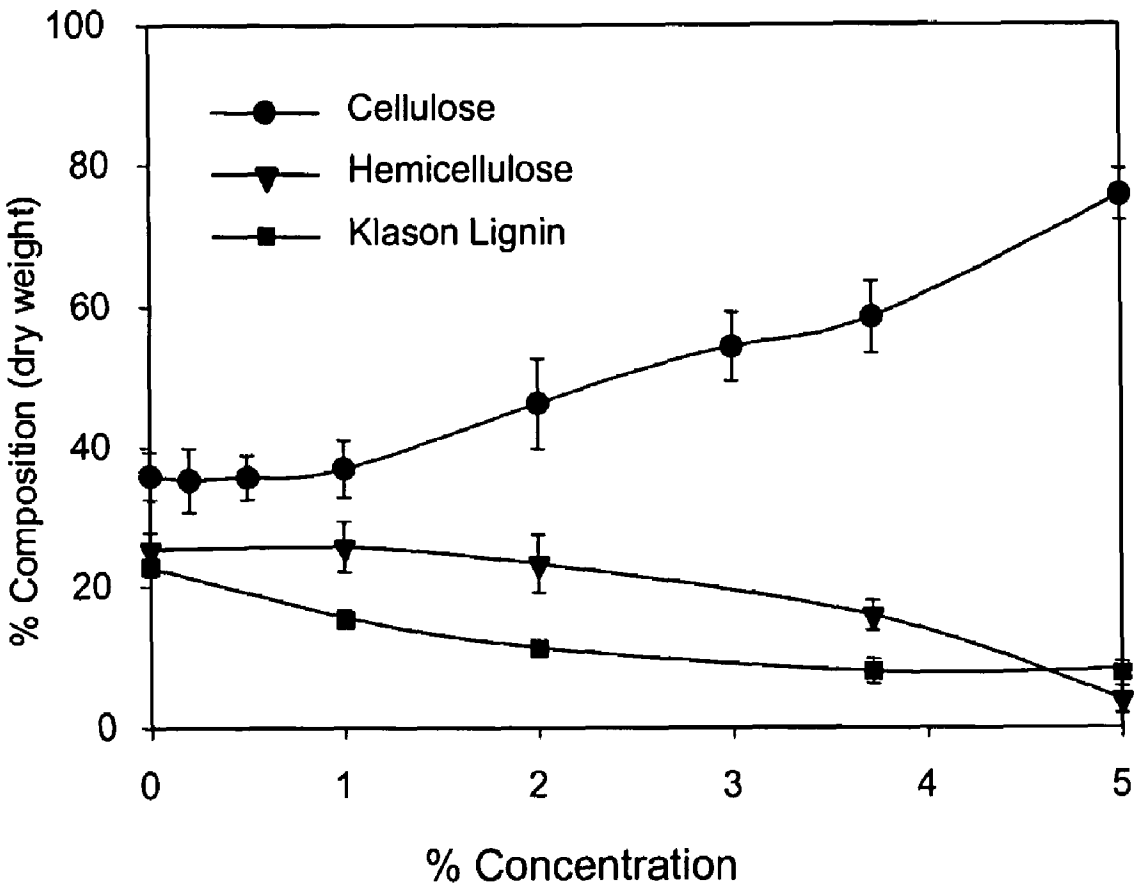
FIG. 1 illustrates the change in percent composition (dry weight) of cellulose, hemicellulose, and lignin in biomass after a 30 min incubation with various concentrations of a 10:1 hypochlorite: peroxide solution ("Ox-B").

We are proposing a simple, efficient method for depolymerizing lignocellulosic materials utilizing a solution that in situ both produces singlet oxygen and bleaches due to hypochlorite. This method produces readily degradable and separable components of biomass, especially cellulose, while using substantially less chemical to degrade the biomass than current methods. This technique acts directly on lignocellulosic materials, and is capable of producing paper pulp in a single step by separating most of the lignin from the other components. This method can be used on any lignocellulosic material, for example, bagasse or corn stover, sawdust, wood, or pine needles. The lignocellulosic material may be processed with the oxidant solution directly, or after other mechanical or chemical treatments depending on the desired end products, e.g. being ground initially or after an initial treatment with steam or NaOH. If the biomass (feedstock) is pretreated either mechanically or chemically, the amount of oxidant solution can be reduced to produce the desired products.

The oxidant solution is a mixture of peroxide and hypochlorite. The composition is formed by adding the peroxide to hypochlorite to form a stable composition, called Ox-B solution. The amount of peroxide added to the hypochlorite is preferably sufficient to provide a hypochlorite to peroxide weight ratio of no less than 5:1, with ratios as high as 50:1, 100:1, or higher being possible but less preferred. Most preferably, the weight ratio is about 10:1. This solution is the subject of a co-pending application, U.S. Application Publication No. 2004/0047915. For use in degradation of biomass, the preferred solution is a concentration less than 5% hypochlorite:0.5% peroxide, the more preferred solution is a concentration less than 2% hypochlorite: 0.2% peroxide, and the most preferred solution is a concentration less than 1% hypochlorite: 0.1% peroxide. The use of this solution allows the biomass to be degraded with very little chemical added. The preferred dry weight ratio of chemical to biomass is no greater than 1 g chemical for each 1 g biomass, the more preferred ratio is no greater than 0.4 g chemical for each 1 g biomass; and the most preferred ratio is no greater than 0.2 g chemical for each 1 g biomass. The amount of oxidant solution can be reduced if other pre or post treatments (such as a dilute caustic wash) are used in conjunction with this process.

The peroxides which may be used in the oxidant solution may include hydrogen peroxide, alkali and alkali earth metal peroxides as well as other metal peroxides. Specific non-limiting examples include barium peroxide, lithium peroxide, magnesium peroxide, nickel peroxide, zinc peroxide, potassium peroxide, sodium peroxide, and the like, with hydrogen and sodium peroxide being preferred, hydrogen peroxide being particularly preferred.

The hypochlorites which may be used in the oxidant solution may include alkali metal hypochlorites such as, e.g., sodium hypochlorite, calcium hypochlorite, lithium hypochlorite, and the like, with sodium hypochlorite preferred.

The biomass feedstock can be treated with the oxidant solution under a wide variety of conditions depending on the desired results. The oxidant solution can be applied for about 10 min to about 72 hrs, at a pH range from about 4 to about 12, and temperatures from about 4° C. to 100° C.

Following treatment with the oxidant solution, the lignin and hemicellulose fraction can be separated from the cellulose-rich solids by any traditional separation process, for example, sedimentation, filtration or centrifugation. The cellulose-rich pulp can then be readily degraded to its component sugars using commercially available cellulases.

EXAMPLE 1

Materials and Methods

Lignocellulosic Material: Sugarcane bagasse (bagasse) was collected from a local sugar mill in Louisiana. To prevent microbial growth during storage, the bagasse was frozen until use. The thawed bagasse was dried in an oven at 80° C. to a constant weight, and then ground using a commercial coffee grinder. The ground bagasse that passed through an 80-mesh filter was used for further treatment. All weights were based on dry weights, and were measured after drying the material to a constant weight in an 80° C. oven.

Treatment with Oxidant Solution. All treatments were performed while stirring at room temperature (25° C.), unless otherwise indicated. Usually, dry grounded bagasse (2.5 g) was mixed with 100 ml of treatment solution, and the mixture stirred at room temperature. To test the effect of temperature, the mixture was placed on a magnetic stirrer plate with a thermostatic water circulator. To vary the pH, the pH was adjusted to the chosen value either with concentrated acid (HCl) or base (sodium hydroxide (NaOH) or sodium carbonate ($NaCO_3$)). For most experiments, the pH value was maintained at pH 8.0 with either 0.1 M sodium carbonate or 10 N NaOH. After 30 min of incubation, the mixture was filtered. The solid fraction (the cellulose residue) was washed with 20 ml 50% ethanol (w/v), and then washed again with 100 ml distilled water. For post-treatment with a caustic wash, the residue was then incubated with 0.6% NaOH for 1 hr at room temperature. The oxidant solution ("Ox-B") was used in concentrations from 1% to 5% sodium hypochlorite, at a ratio of 10:1 hypochlorite:peroxide. For example, a 5% Ox-B solution is equal to 5 g sodium hypochlorite with 0.5 g hydrogen peroxide in 100 ml of solution; while a 2% Ox-B solution is equal to 2 g sodium hypochlorite with 0.2 g hydrogen peroxide in 100 ml water. All chemicals were commercially purchased from Sigma Co. (St. Louis, Mo.), unless otherwise specified.

Composition of treated bagasse. Structural carbohydrates and lignin of bagasse before and after treatment were determined by the method as described by the National Renewable Energy Laboratory (NREL, Nov. 2004 accessed; at the website http://www.eere.energy.gov/biomass/analytical_procedures.html).

Enzyme saccharifications. Enzymatic hydrolysis of the cellulose residue was conducted using a crude cellulase enzyme from *Trichoderma viride* (Cat. No. 9422, Sigma Co., St. Louis, Mo.). The enzyme activity was measured as Filter Paper Units (FPU/g solid) according to NREL procedure. Samples of treated bagasse were incubated for 72 h with enzyme (10 FPU/ g of pretreated bagasse) at 37° C. and shaken at 200 rpm. The degree of cellulose hydrolysis was expressed as percent production of mono- and disaccharides as compared to the weight prior to hydrolysis. The mono- and disaccharides are measured as below.

Sugar Analysis. Samples were obtained at several time intervals during saccharification. Xylose, glucose, arabinose and cellobiose were determined by the use of a Waters system HPLC with an Aminex-HPX-87K Bio-Rad column (Bio-Rad Lab., Hercules, California) run at 85° C. with $K_2HPO_4$ as eluent, at a constant flow rate of 0.6 ml/min. The Refractive Index was used for detection of sugars. The concentration of sugars from the HPLC was used to calculate the % mono- and disaccharides in the residue, which is a measure of cellulose hydrolysis.

EXAMPLE 2

Effect of pH and Temperature on Ox-B Degradation

Initial experiments were conducted to find the effect of pH and temperature on the efficiency of the Ox-B solution to degrade biomass and to promote cellulose hydrolysis. These initial experiments were conducted with a 2% Ox-B solution (i.e., 2 g sodium hypochlorite, 0.2 g hydrogen peroxide, and 100 ml solution) at 25° C., followed by a caustic wash of 0.6% NaOH before the cellulose hydrolysis. The range in pH was from 4 to 12. There was not a significant difference in the amount of cellulose hydrolysis under the different pH conditions. All solutions showed cellulose hydrolysis greater than about 80%, with the highest being about pH 6 (about 95%) and the lowest about pH 10 (about 80%). (Data not shown) In a similar manner, a 2% Ox-B solution (pH 8.0) followed by a caustic wash was used to test the effects of temperature, from 25° C. to 90° C. Again, the cellulose hydrolysis as measured by the percent mono- and disaccharides was independent of temperature, with all conditions showing about 90% or greater cellulose hydrolysis. (Data not shown).

EXAMPLE 3

Comparison of Ox-B Solution and Hypochlorite Solution

Several concentrations of Ox-B solution were used to monitor the change in the primary compounds (based on percent of dry weight) present in biomass (cellulose, hemicellulose, and lignin) after a 30-min incubation with a Ox-B solution with concentrations from 1% to 5%. The results-are shown in FIG. 1 and indicate that as the concentration of Ox-B increases from 1% to 5%, the amount of cellulose increases while the amount of hemicellulose and lignin decreases.

Figure 2A:
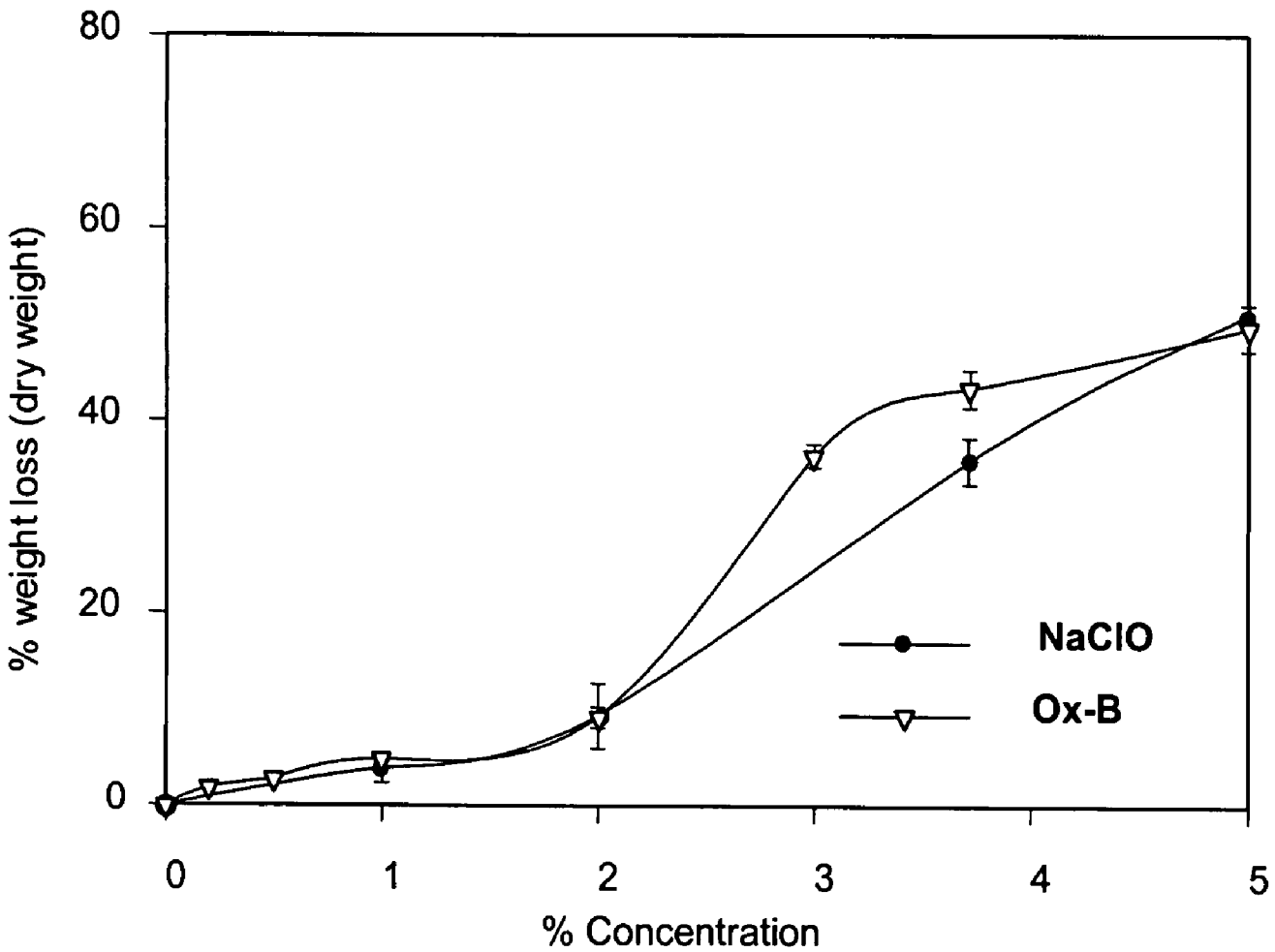
FIG. 2A illustrates the percent weight loss (dry weight) of biomass after a 30 min incubation with various concentrations of a sodium hypochlorite solution or a 10:1 hypochlorite: peroxide solution ("Ox-B").
Figure 2B:
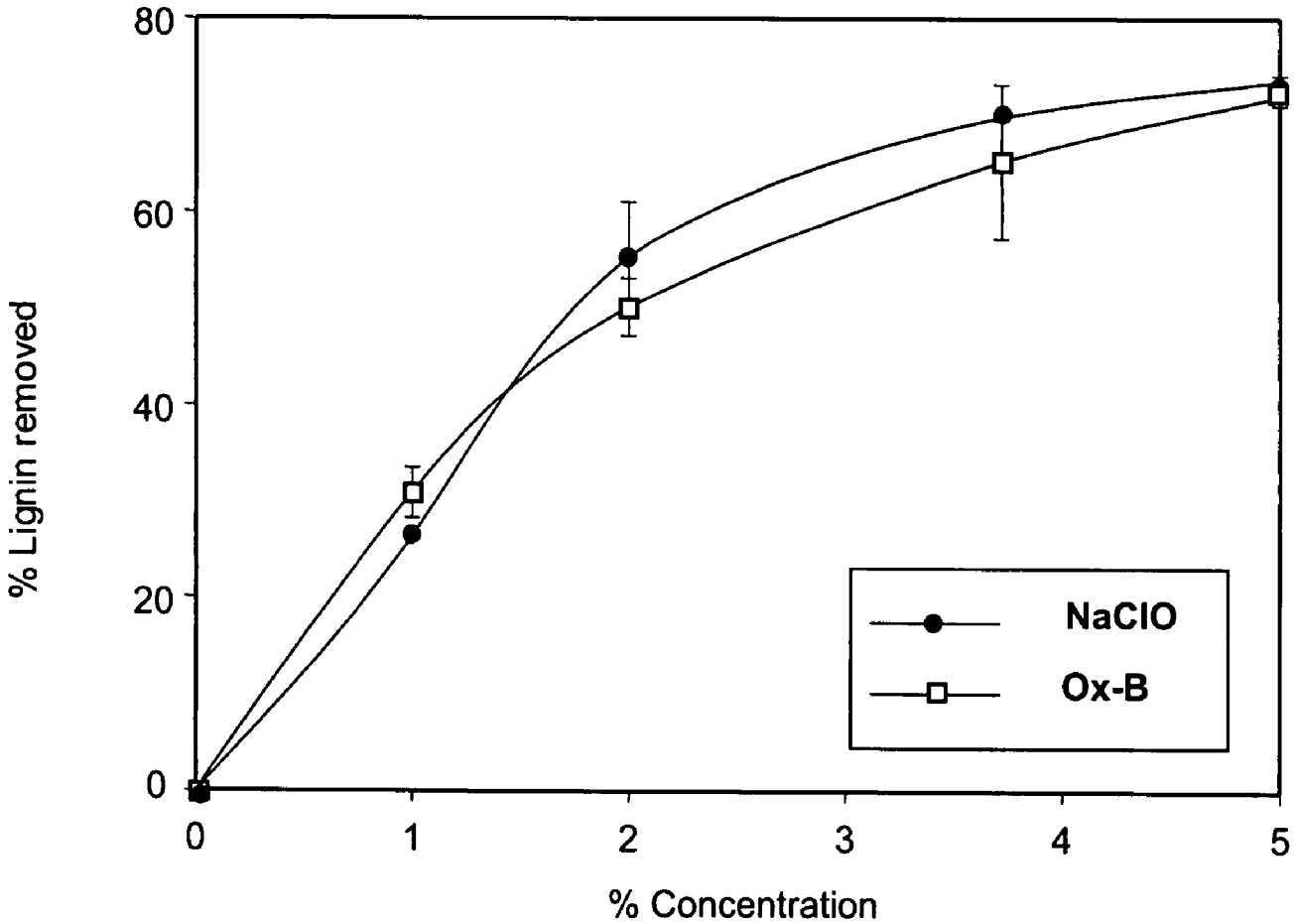
FIG. 2B illustrates the percent removal of lignin (dry weight) of biomass after a 30 min incubation with various concentrations of a hypochlorite solution or a 10:1 hypochlorite: peroxide solution ("Ox-B").
Figure 3:
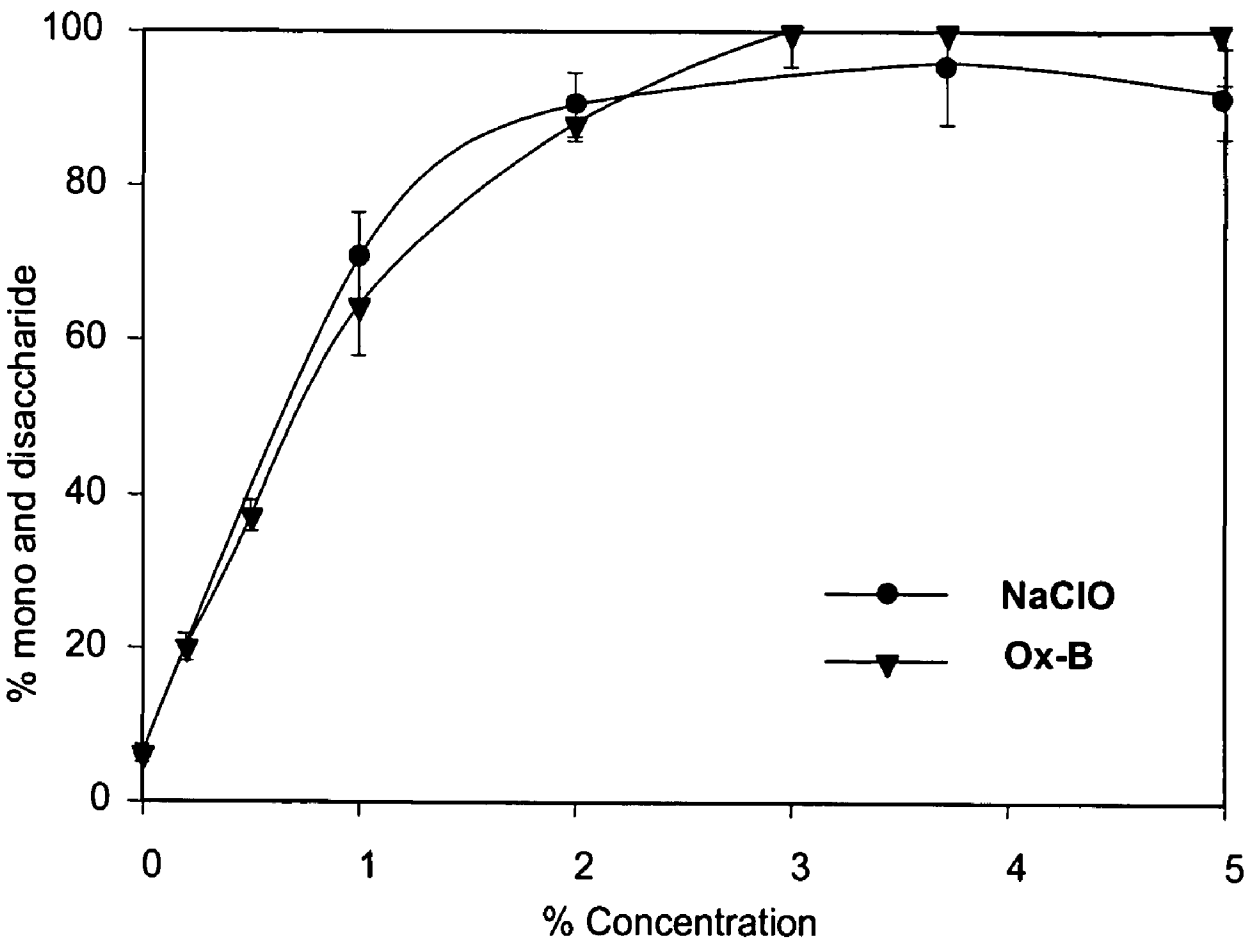
FIG. 3 illustrates the percent recovery of mono- and disaccharides as indicators of cellulose hydrolysis of biomass initially treated for 30 min with various concentrations of a hypochlorite solution or a 10:1 hypochlorite: peroxide solution ("Ox-B"), and then incubated for 72 h with a crude cellulase enzyme.

Similar concentrations of Ox-B and a hypochlorite solution were used to degrade bagasse following the procedure discussed above in Example 1. When the percent weight loss is measured after a 30 min incubation, the two solutions perform very similarly, as shown in FIG. 2A. Similar results are also seen when measuring the percent lignin removed as shown in FIG. 2B, and when measuring the degree of cellulose hydrolysis (after 72 h incubation with a cellulase) as shown in FIG. 3. Thus based on this analysis, Ox-B was very similar to hypochlorite in rapidly removing the lignin and hemicellulose from bagasse, and in the degree of enzyme hydrolysis of the resulting cellulose residue.

EXAMPLE 4

Effects of a Post-Treatment Caustic Wash

Figure 4:
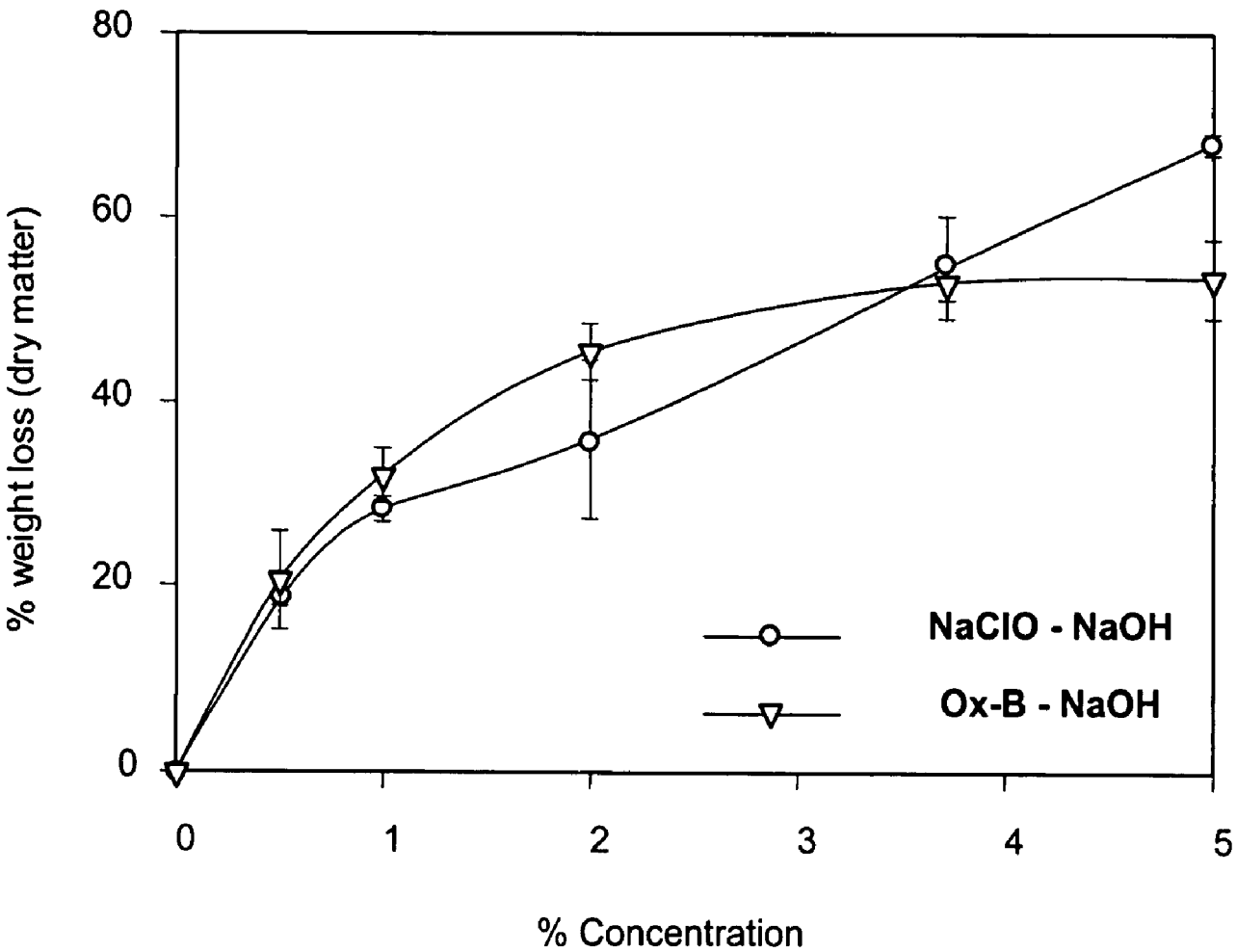
FIG. 4 illustrates the percent weight loss (dry weight) of biomass after a 30 min incubation with various concentrations of a hypochlorite solution or a 10:1 hypochlorite: peroxide solution ("Ox-B"), each followed by a 1 h incubation with a caustic wash (0.6% w/v NaOH).

To further compare the efficiency of Ox-B and hypochlorite to provide substrate for cellulose degradation, experiments were conducted as described above, except that prior to the enzymic hydrolysis, the cellulose residue was incubated for 1 h with 0.6% NaOH. As shown in FIG. 4, this subsequent treatment produced similar results in terms of the percent weight loss in the sample for both Ox-B (from 0.5 to 5%) and hypochlorite (from 0.5 to 5%) solutions.

Figure 5A:
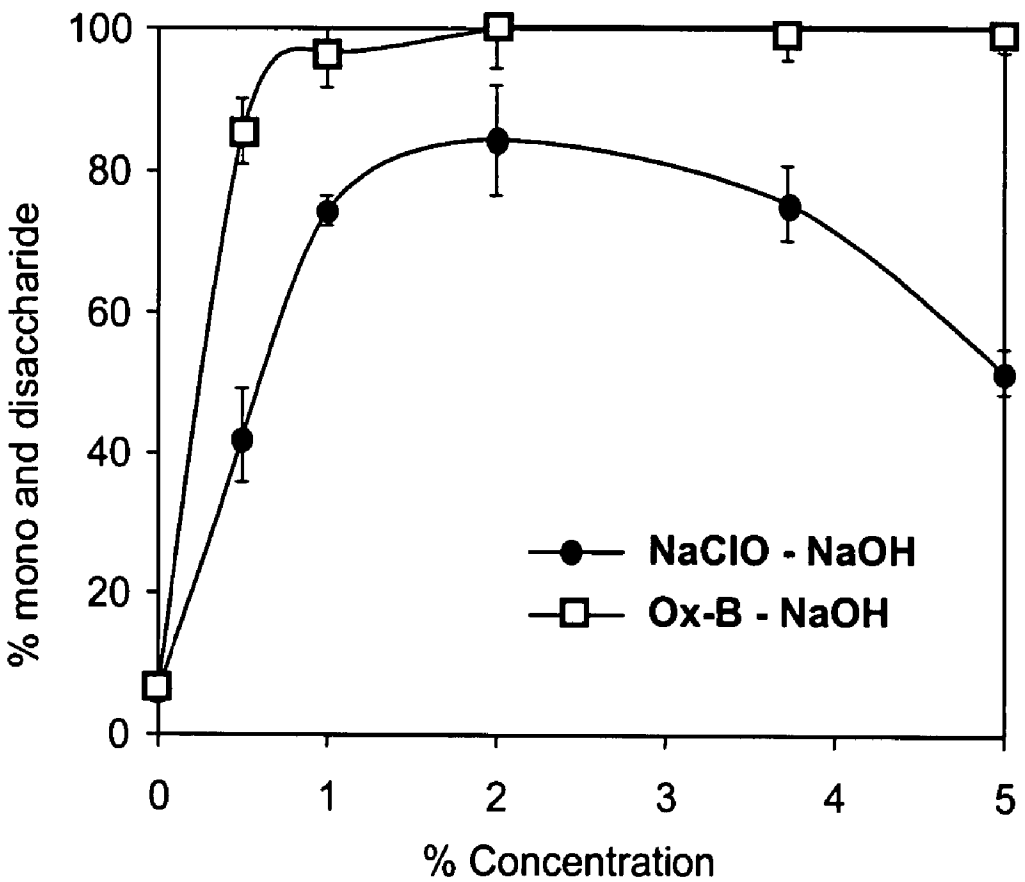
FIG. 5A illustrates the percent recovery of mono- and disaccharides as indicators of cellulose hydrolysis of biomass initially treated for 30 min with various concentrations of a hypochlorite solution or a hypochlorite: peroxide solution ("Ox-B"), followed with 1 h incubation with a caustic wash (0.6% w/v NaOH), and then incubated for 72 h with a crude cellulase enzyme.

However, a surprising difference between the Ox-B and hypochlorite treatments was seen when the amount of cellulose hydrolysis is measured (as percent mono- and disaccharides). As shown in FIG. 5A, treatment with concentrations of Ox-B as low as 1% resulted in almost 100% hydrolysis of the cellulose. In contrast, the cellulose hydrolysis of the hypochlorite treatments reached a maximum (about 80%) at a concentration of about 2% and then dropped as the concentration increased.

Figure 5B:
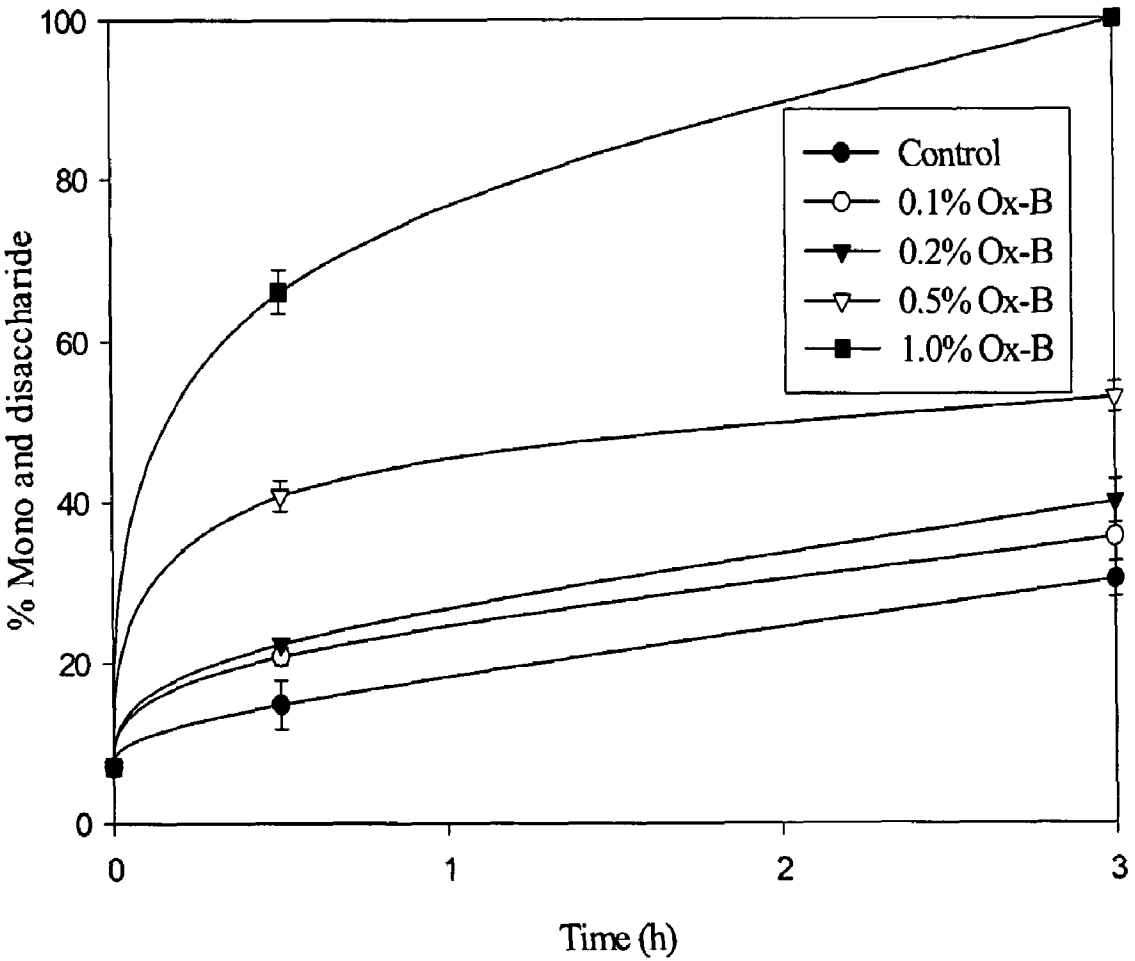
FIG. 5B illustrates the percent recovery of mono- and disaccharides as indicators of cellulose hydrolysis of biomass initially treated for 30 min and for 3 h at pH 8.0 with various concentrations (0.1%, 0.2%, 0.5%, and 1.0%) of a hypochlorite: peroxide solution ("Ox-B"), and then incubated for 72 h with a crude cellulase enzyme.

In addition, when different concentrations of the Ox-B treatment were used at pH 8.0, the amount of cellulose hydrolysis reached about 50% of the total hydrolysis at about 10 min. Again, 1% Ox-B resulted in 100% hydrolysis, while 0.5% resulted in 50% hydrolysis. (FIG. 5B) All concentrations resulted in hydrolysis greater than 20%. Again, cellulose hydrolysis was measured as percent mono- and disaccharides after incubation for 72-h with a crude cellulase enzyme.

Figure 6:
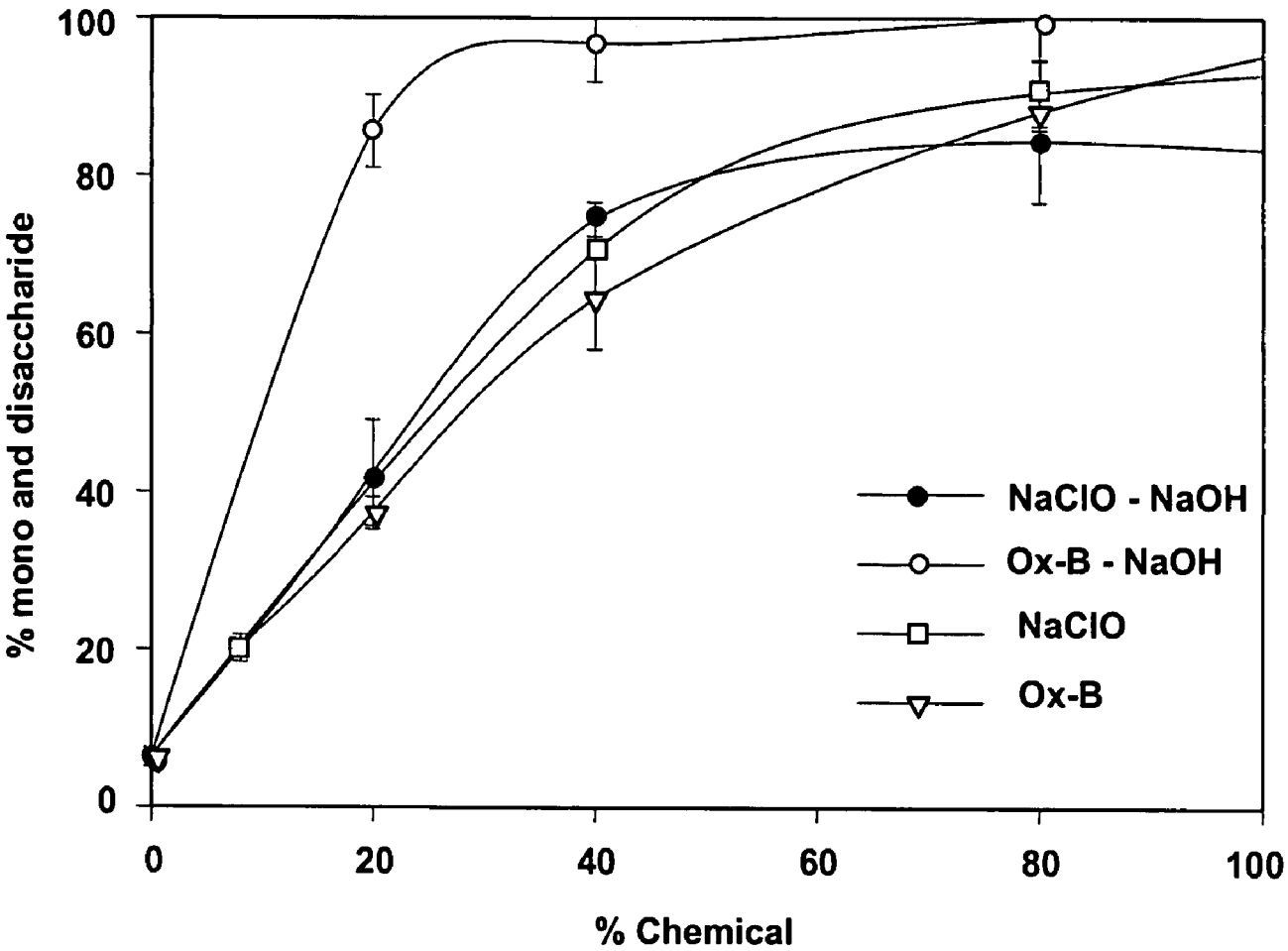
FIG. 6 illustrates the percent recovery of mono- and disaccharides as indicators of cellulose hydrolysis of biomass initially treated for 30 min with various concentrations, expressed as percent chemical added per dry weight of initial biomass, of a hypochlorite solution (NaClO) or a hypochlorite: peroxide solution ("Ox-B") with some examples followed with incubation for 1 h with a caustic wash (0.6% w/v NaOH), before incubating for 72 h with a crude cellulase enzyme.

When these concentrations are expressed as percent chemical added to the original biomass (i.e., 1 g chemical added to 1 g biomass would be 100%), the difference in cellulose hydrolysis is clearly shown among the treatments of Ox-B, hypochlorite, Ox-B followed by NaOH wash, and hypochlorite followed by NaOH wash. These results are shown in FIG. 6. The Ox-B treatment followed by caustic wash showed high levels of cellulose hydrolysis (greater than 80%) at 20%, 40% and 80% chemical. For Ox-B, 20% chemical is a solution of 0.5% sodium hypochlorite and 0.05% hydrogen peroxide; 40% chemical is a solution of 1% sodium hypochlorite and 0.1% hydrogen peroxide; and 80% chemical is a solution of 2% sodium hypochlorite and 0.2% hydrogen peroxide. The caustic wash did not improve the cellulose hydrolysis of hypochlorite treatments. Thus a combination of posttreatment with caustic at chemical levels less than 40% (g chemical/gm dry biomass; equivalent to treatment with a 1% Ox-B solution) highlighted a difference in the degradation of bagasse between Ox-B and hypochlorite. The Ox-B solution made the cellulose more available for hydrolysis by cellulase. Solutions of hypochlorite at concentrations above 2% reduced the availability of cellulose to enzyme attack. (FIGS. 5 and 6).

A singlet oxygen complex (Ox-B, a solution of about 10:1 sodium hypochlorite: hydrogen peroxide) was found to remove both lignin and hemicellulose from sugarcane bagasse. After treatment the cellulosic residue readily separated from the lignin and hemicellulose by sedimentation. The residue (the pulp) contained up to 80% by weight cellulose, and was easily degradable by cellulase enzyme. A treatment of oxidation, followed by a caustic wash, produced a cellulose residue that was between 85 and 100% degraded to simple sugar by cellulase at very low concentrations of Ox-B. Due to the low amount chemical used and the efficiency of the degradation, this process has commercial potential.

The complete disclosures of all references cited in this specification are hereby incorporated by reference. Also, incorporated by reference is the complete disclosure of the following: Chang-Ho Chung et al., "Chemical Oxidation for Cellulose Separation," a poster to be presented at the American Chemical Society Meeting, San Diego, Calif., Mar. 13, 2005. In the event of an otherwise irreconcilable conflict, however, the present specification shall control.

We claim:

1. A method to separate cellulose from lignin in a lignocellulosic material, said method comprising the steps of the following:

(a) mixing the lignocellulosic material with an oxidizing solution, wherein said lignocellulosic material is not chemically treated to remove lignin prior to mixing with the oxidizing solution forming a mixture; wherein said oxidizing solution comprises a peroxide and a hypochlorite, wherein the oxidizing solution is formed by adding a peroxide ingredient to a hypochlorite ingredient so that the weight ratio of the hypochlorite to the peroxide is no less than about 5:1 to a maximum of about 100:1; and incubating said mixture for a time period no less than about 10 min, wherein at the end of the incubation period said mixture contains a solid fraction containing cellulose and a liquid fraction containing lignin; and (b) separating said liquid fraction from said solid fraction.

2. A method as in claim 1, wherein in the mixture of lignocellulosic material and oxidizing solution, the ratio of the weight of the peroxide and the hypochlorite to the weight of the lignocellulosic material is no greater than about 1:1.

3. A method as in claim 1, wherein in the mixture of lignocellulosic material and oxidizing solution, the ratio of the weight of the peroxide and the hypochlorite to the weight of the lignocellulosic material is no greater than about 0.4:1.

4. A method as in claim 1, wherein in the mixture of lignocellulosic material and oxidizing solution, the ratio of the weight of the peroxide and the hypochlorite to the weight of the lignocellulosic material is no greater than about 0.2:1.

5. A method as in claim 1, wherein the lignocellulosic material is selected from the group consisting of sugarcane bagasse, corn stover, saw dust, wood, and pine needles.

6. A method as in claim 5, wherein the lignocellulosic material is sugarcane bagasse.

7. A method as in claim 1, wherein the peroxide is an alkali metal peroxide.

8. A method as in claim 1, wherein the peroxide is sodium peroxide.

9. A method as in claim 1, wherein the peroxide is hydrogen peroxide.

10. A method as in claim 1, wherein the hypochlorite is an alkali metal hypochlorite.

11. A method as in claim 1, wherein the hypochlorite is sodium hypochlorite.

12. A method as in claim 1, wherein the peroxide is hydrogen peroxide and the hypochlorite is sodium hypochlorite.

13. A method as in claim 12, wherein the weight ratio of the sodium hypochlorite to the hydrogen peroxide is about 10:1.

14. A method of producing sugars from a lignocellulosic material, said method comprising the following steps:

(a) mixing the lignocellulosic material with an oxidizing solution, wherein said lignocellulosic material is not chemically treated to remove lignin prior to mixing with the oxidizing solution forming a mixture; wherein said oxidizing solution comprises a peroxide and a hypochlorite, wherein the oxidizing solution is formed by adding a peroxide ingredient to a hypochlorite ingredient so that the weight ratio of the hypochlorite to the peroxide is no less than about 5:1 to a maximum of about 100:1; and incubating said mixture for a time period no less than about 10 min, wherein at the end of the incubation period said mixture contains a solid fraction containing cellulose and a liquid fraction containing lignin;

(b) separating said liquid fraction from said solid fraction; and (c) incubating said solid fraction with an enzyme, wherein said enzyme hydrolyzes the cellulose in the solid fraction into sugars.

15. A method as in claim 14, further comprising the step of incubating the solid fraction with a weak alkali solution prior to the incubation with the enzyme.

16. A method as in claim 15, wherein the weak alkali solution is a solution of sodium hydroxide.

17. A method as in claim 14, wherein the enzyme is a cellulase.

18. A method as in claim 14, wherein in the mixture of lignocellulosic material and oxidizing solution, the ratio of the weight of the peroxide and the hypochlorite to the weight of the lignocellulosic material is no greater than about 1:1.

19. A method as in claim 14, wherein in the mixture of lignocellulosic material and oxidizing solution, the ratio of the weight of the peroxide and the hypochlorite to the weight of the lignocellulosic material is no greater than about 0.4:1.

20. A method as in claim 14, wherein in the mixture of lignocellulosic material and oxidizing solution, the ratio of the weight of the peroxide and the hypochlorite to the weight of the lignocellulosic material is no greater than about 0.2:1.

21. A method as in claim 14, wherein the lignocellulosic material is selected from the group consisting of sugarcane bagasse, corn stover, saw dust, wood, and pine needles.

22. A method as in claim 21, wherein the lignocellulosic material is sugarcane bagasse.

23. A method as in claim 14, wherein the peroxide is an alkali metal peroxide.

24. A method as in claim 14, wherein the peroxide is sodium peroxide.

25. A method as in claim 14, wherein the peroxide is hydrogen peroxide.

26. A method as in claim 14, wherein the hypochlorite is an alkali metal hypochlorite.

27. A method as in claim 14, wherein the hypochlorite is sodium hypochlorite.

28. A method as in claim 14, wherein the peroxide is hydrogen peroxide and the hypochlorite is sodium hypochlorite.

29. A method as in claim 28, wherein the weight ratio of the sodium hypochlorite to the hydrogen peroxide is about 10:1.

* * * * *

UNITED STATES PATENT AND TRADEMARK OFFICE

CERTIFICATE OF CORRECTION

PATENT NO. : 7,585,387 B2
APPLICATION NO. : 11/371523
DATED : September 8, 2009
INVENTOR(S) : Day et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 230 days.

Signed and Sealed this

Fourteenth Day of September, 2010

David J. Kappos

David J. Kappos
*Director of the United States Patent and Trademark Office*